US006702574B1

(12) United States Patent
Döbbeling

(10) Patent No.: US 6,702,574 B1
(45) Date of Patent: Mar. 9, 2004

(54) BURNER FOR HEAT GENERATOR

(75) Inventor: Klaus Döbbeling, Windisch (CH)

(73) Assignee: Alstom (Schweiz) AG, Baden (CH)

( * ) Notice: Subject to any disclaimer, the term of this patent is extended or adjusted under 35 U.S.C. 154(b) by 0 days.

(21) Appl. No.: 09/869,062

(22) PCT Filed: Dec. 21, 1999

(86) PCT No.: PCT/CH99/00617

§ 371 (c)(1),
(2), (4) Date: Jun. 25, 2001

(87) PCT Pub. No.: WO00/39503

PCT Pub. Date: Jul. 6, 2000

(30) Foreign Application Priority Data

Dec. 23, 1998 (DE) ..... 198 59 829

(51) Int. Cl.[7] ..... F23D 14/46
(52) U.S. Cl. ..... 431/350; 431/182; 239/403
(58) Field of Search ..... 431/350, 351, 431/352, 353, 354, 115, 116, 181, 182, 183, 187, 188; 239/399, 402, 403, 405

(56) References Cited

U.S. PATENT DOCUMENTS

| | | | | |
|---|---|---|---|---|
| 4,081,957 A | | 4/1978 | Cox, Jr. | |
| 4,479,775 A | | 10/1984 | Wiesel | |
| 4,548,578 A | * | 10/1985 | Hannen | 431/350 |
| 5,454,220 A | | 10/1995 | Althaus et al. | |
| 5,577,378 A | | 11/1996 | Althaus et al. | |
| 5,735,126 A | * | 4/1998 | Schulte-Werning | 431/350 |
| 5,738,508 A | * | 4/1998 | Dobbeling et al. | 431/354 |
| 5,954,490 A | * | 9/1999 | Knopfel et al. | 431/353 |

FOREIGN PATENT DOCUMENTS

| | | | |
|---|---|---|---|
| DE | 4435266A12 | | 4/1996 |
| DE | 19547913 A1 | | 6/1997 |
| DE | 19639301 A1 | | 3/1998 |
| EP | 0 306 072 A1 | * | 3/1989 |
| EP | 0620362 A1 | | 10/1994 |
| EP | 0745809 A1 | | 12/1996 |
| EP | 0797051 A2 | | 9/1997 |
| EP | 0833104 A2 | | 4/1998 |
| EP | 0835996 A1 | | 4/1998 |
| EP | 0908671 A1 | | 4/1999 |
| WO | WO - 95/02789 A1 | * | 1/1995 |

* cited by examiner

*Primary Examiner*—Josiah Cocks
(74) *Attorney, Agent, or Firm*—Burns, Doane, Swecker & Mathis, L.L.P.

(57) ABSTRACT

A burner for operating a heat generator, includes a swirl generator (100) for a combustion air flow (115) means for injecting at least one fuel into the combustion air flow. A mixing section is arranged downstream of this swirl generator, which mixing section has, within a first section in the flow direction, a number of ducts in a transition piece (200) for the transfer of a flow formed in the swirl generator into a mixing tube (20) connected downstream of this transition piece. A combustion space (30) is arranged downstream of this mixing tube. The swirl generator (100) is integrated into an inlet flow cross section (10) which is essentially closed by the swirl generator, and is subjected to the combustion air flow (115).

10 Claims, 3 Drawing Sheets

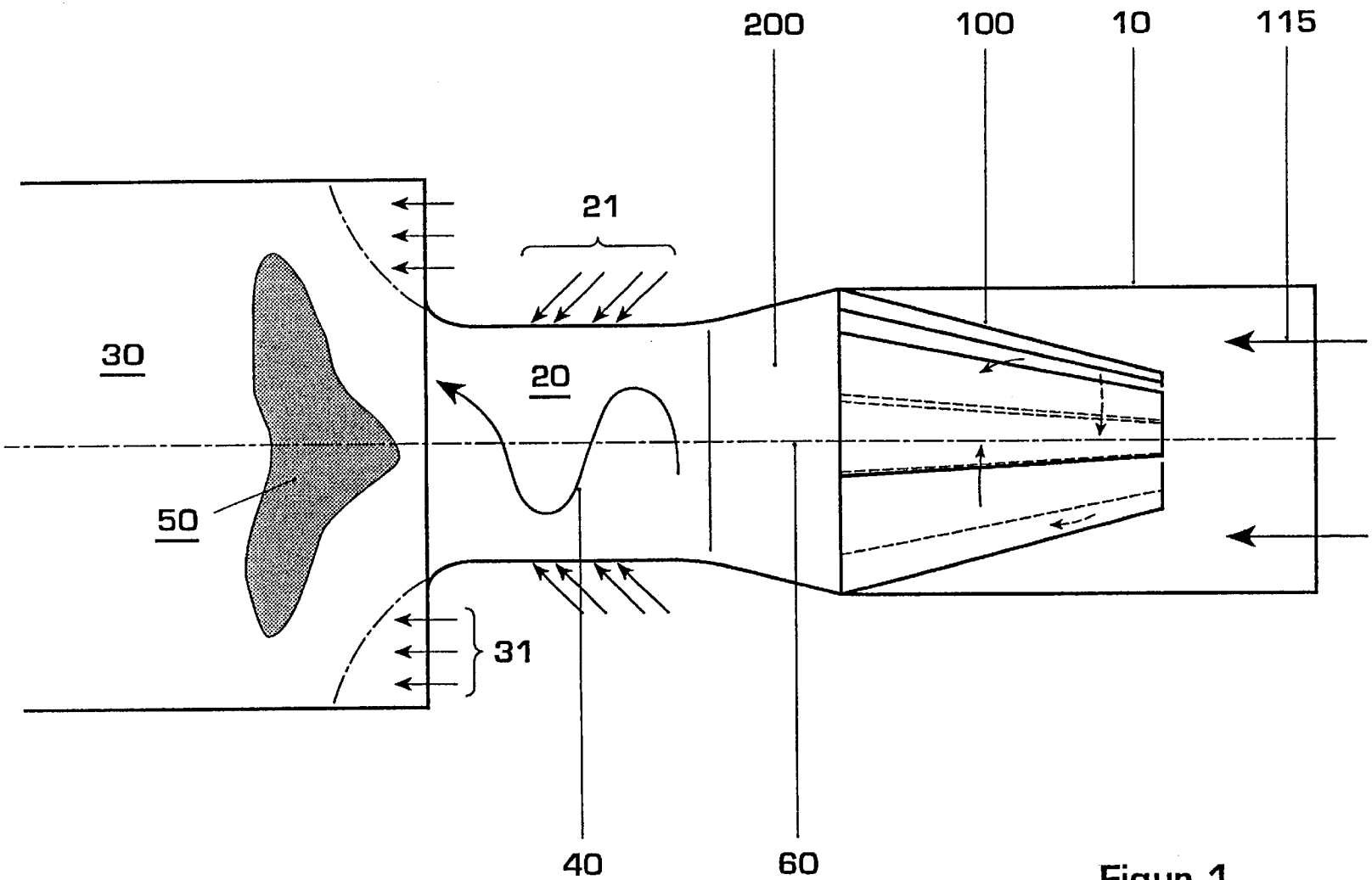
Figur 1

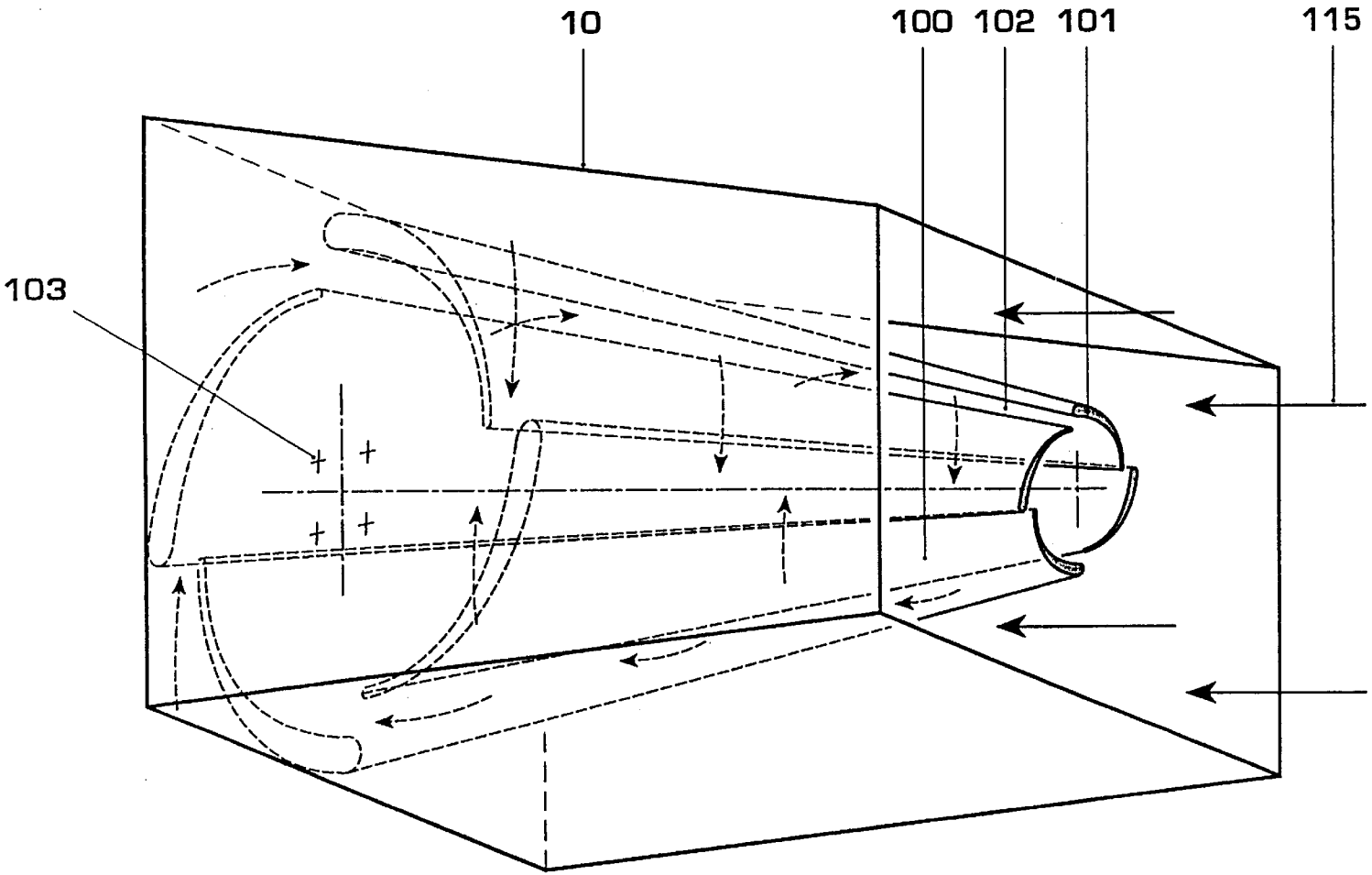
Figur 2

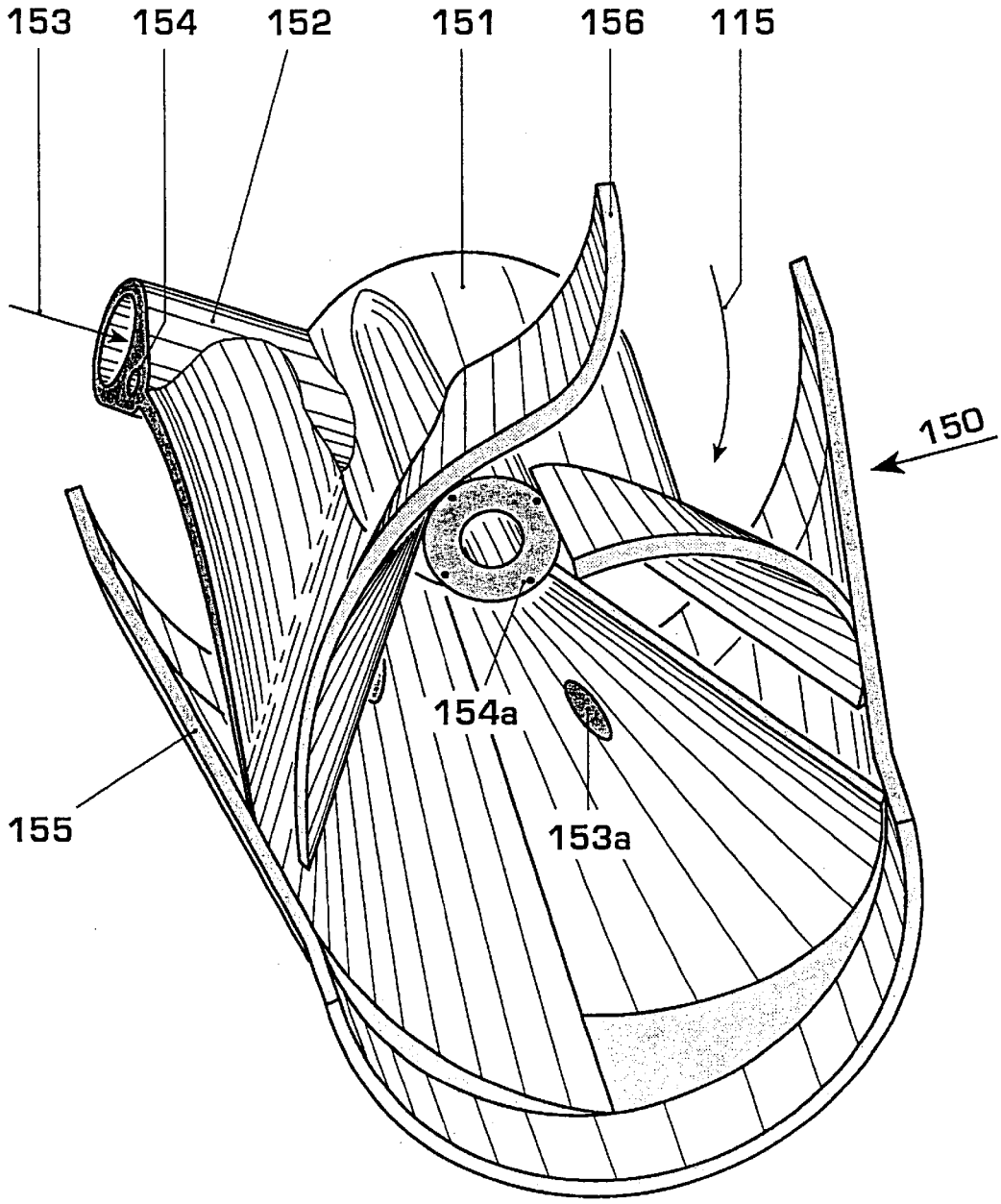
Figur 3

BURNER FOR HEAT GENERATOR

FIELD OF THE INVENTION

The present invention relates to a burner for operating a heat generator, the burner having a swirl generator and a mixing section downstream of the swirl generator.

BACKGROUND OF THE INVENTION

In order to achieve high efficiencies and high power densities, the principle of staged combustion is employed in modem gas turbines. With staged combustion, a hot gas is generated in a high-pressure combustion chamber, preferably equipped with premixing burners (see EP-0 321 809 B1). After partial expansion in a first high-pressure turbine, this hot gas flows into a second combustion chamber (reheat combustion chamber), in which the partially expanded hot gas is reheated to the maximum turbine entry temperature, so that such a gas turbine is based on sequential combustion. Such a gas turbine is disclosed in U.S. Pat. Nos. 5,454,220, and 5,577,378, and EP-0 620 362 A1, all of which are incorporated herein by reference.

The reheat combustion chamber has a configuration which is shown and described in more detail in the publications EP-0 745 809 A1 and EP-0 835 996 A1, these publications likewise being incorporated herein by reference.

This combustion chamber is of annular configuration and has, essentially, a series of individual adjacent transfer ducts which form the individual burners of this combustion chamber. These individual burners have an almost rectangular cross section. Mixing occurs in these individual burners between the fuel and the oxygen-containing partially expanded hot gas, called combustion air, which comes from the first turbine. This mixing takes place by means of a plurality of longitudinal vortex generators, also called vortex generators, which are attached to the cold walls of the mixing section and are themselves cooled. These longitudinal vortex generators (see EP-0 745 809 A1) generate, on their surfaces, a flow separation and deflection which finally leads to the formation of longitudinal vortices. The rectangular mixing duct is almost filled by a plurality of these longitudinal vortices. It has been found that such a configuration can lead to shortcomings for quite specific types of operation and operating parameters:

a) A substantial recooled air mass flow is required for cooling the mixing section and the longitudinal vortex generator.

b) The longitudinal vortices generated cannot completely cover the flow cross section, particularly in the right angled corners of the mixing duct.

c) During the generation of the longitudinal vortices, kinetic energy is dissipated into turbulence in the separation regions of the longitudinal vortex generators and only a part of the kinetic energy is converted into the longitudinal vortex motion.

d) After the step-shaped expansion into the combustion chamber, the flow attaches to the combustion chamber wall only after a substantial distance, i.e. undesirable dead water and reverse flow regions occur after the step discontinuity.

SUMMARY OF THE INVENTION

In view of the above-discussed problems with convention al premixing burners, and according to an embodiment of the present invention, mixing of the combustion air, i.e. the partially expanded hot gases and fuel, is effected in a round mixing section, which mixing section is filled by a single swirled flow. A conical swirl generator is provided, with the conical swirl generator including a plurality of partial bodies, or swirl generator vanes, which swirl the combustion air. The swirl generator vanes are installed for swirl generation in the entry cross section, whose rectangular shape is retained. The entry slots formed by the swirl generator vanes are present between the individual partial bodies of the swirl generator and are preferably of constant slot width, but they can have a variable slot width along their length. Four inlet slots are preferably provided, although embodiments with a different number of slots are also possible. A swirl generator according to an embodiment of the present invention has some similarities and a number of significant differences relative to a swirl generator such a s is described in DE-44 35 266 A1. As an example, the swirl generator according to the invention is installed in an initially rectangular duct, with this duct merging over the length of the swirl generator into a duct with approximately square or round cross section. This design helps to ensure a clean incident flow onto the swirl generator inlet slots, thereby avoiding any possible flow separations.

A fuel distribution system for gaseous and/or liquid fuels is integrated into the swirl generator, the fuel distribution taking place along the inlet slots, as is disclosed in the last-mentioned publication, through the trailing edges of the swirl generator vanes or by axial injection of the fuel from the vane surface. The injection of a low calorific value or medium calorific value fuel (Lbtu, Mbtu) is generally involved. The fuel can, if necessary, be surrounded by a cold carrier-air flow or inert gas flow in order to avoid premature ignition of the fuel. Liquid fuels are advantageously injected at the upstream end of the swirl generator through a plurality of injection jets. In accordance with the invention, it has been found that it is extremely advantageous for the number of the injection jets to agree with the number of inlet slots in the swirl generator or the number of swirl generator vanes.

A free flow duct, which prevents a reverse flow zone from becoming established in the mixing tube, is located on the axis of the swirl generator. The supply of liquid fuel must therefore take place external to the axis, preferably by means of the multiple nozzle system already mentioned above.

In order to protect the swirl generator vanes from oxidation attacks, as a consequence of the hot inlet temperatures, these swirl generator vanes can be manufactured from a ceramic material and/or can be provided with an internal air cooling system. The design and manufacture of the air-cooled swirl generator vanes follows from the rules known from cooled turbine blades; the heat transfer coefficients, however, are substantially smaller because of the lower flow velocities as compared with rotor blades or guide vanes in the turbine.

Downstream of the swirl generator, the flow is guided within a cylindrical mixing tube. The transition from the swirl generator to the mixing tube is preferably designed in such a way that the flow cross-sectional area is almost constant so that no flow separations occur. This can be achieved either by means of a specially shaped transition piece or by immersing the swirl generator vanes in the cylindrical duct. A further possibility can include providing the swirl generator vanes with a trailing edge which is cut away in the axial direction. In this arrangement, the length of the mixing tube is selected in such a way that the fuel injection cannot, before the end of the mixing tube, exceed the self-ignition time of the selected fuels. The length of the mixing section can vary between zero and two burner diameters depending on the size of the burner and as a function of the burner pressure loss selected.

Flame flashback blockage films can be introduced in order to avoid flashback of the flame into the boundary layers which build up on the transition piece and the mixing tube.

A separating edge, which can be configured in various ways, can be applied to the downstream end of the mixing tube. This separating edge stabilizes the boundary layer by means of the Coanda effect, due to a convex curvature of the end part, and deflects the whole of the flow toward the outside. This has, on the one hand, the effect that the flow in the combustion chamber attaches to the wall more rapidly, and is decelerated more rapidly, so that a turbulent flame front can be established. On the other hand, a part of the dynamic pressure can be recovered in the manner of a diffuser effect because of the deceleration at the end of the mixing tube.

The swirl strength can be made sufficiently strong for a reverse-flow region to occur on the axis downstream of the mixing section. The swirl strength should, however, be of such a strength that the flow downstream of the mixing tube and within one mixing tube diameter on the axis is only decelerated to velocities smaller than the combustion chamber velocity averaged over the cross section. The turbulent velocity fluctuations generated during this loss-affected deceleration serve to stabilize the flame.

The supply of fuel to the swirl generator takes place by means of a fuel and cooling air supply system extending radially relative to the burner axis. The swirl generators can be fastened to the fuel supply system and, together with the latter, can be removed radially from the gas turbine without the need to lift the casing.

Some important advantages of the invention may be seen in the fact that:

a) the surface area sensitive to flame flash-back is minimized by the design, according to the invention, of the mixing section as a cylindrical tube; by this means, the cooling and filling air required for flash-back blockage and for cooling the wall is reduced and, therefore, the overall process is optimized;

b) it is possible to fill the complete mixing section in an optimum manner with a single longitudinal vortex by means of the design, according to the invention, of the mixing section as a cylindrical tube;

c) the injection of the fuel along the inlet slot permits satisfactory fine distribution, by which means the mixing section necessary after the swirl generator is minimized;

d) the swirl generation takes place in a low-loss manner, i.e. no separation regions and no total-pressure loss zones are generated in the case of a design according to the invention. As a result, the pressure loss coefficient of the burner is small in relation to the effective flow cross section and only a little flame-stabilizing turbulence is present in the mixing section so that flame flash-back is avoided even at low flow velocities;

e) because of the strong flow deceleration downstream of the mixing tube, it is possible to increase the opening ratio, namely the ratio of the mixing tube cross section to the proportional combustion chamber cross section to values ranging from more than 4 to at least 10. Because of this, it is possible to construct an essentially shorter combustion chamber while retaining the same residence time and, therefore, satisfactory burn-out;

f) the swirl generator and the fuel injection can be structurally designed in such a way that they can be removed radially outward without removing the gas turbine casing.

Replacement swirl generators can therefore be easily fitted and a change to different fuels or fuel injection systems can be effected more easily.

BRIEF DESCRIPTION OF THE DRAWINGS

Exemplary embodiments of the invention are explained in more detail below by the detailed description taken in conjunction with the drawings. Features which are unimportant for an understanding of the invention have been omitted. The same elements are provided with the same designations in the various figures. The flow direction of the media is indicated by arrows.

In the drawings:

FIG. 1 shows a diagrammatic section through a burner.

FIG. 2 shows, in perspective view, a configuration of the swirl generator installed.

FIG. 3 shows a further embodiment of a swirl generator.

DETAILED DESCRIPTION OF THE PREFERRED EMBODIMENTS

FIG. 1 shows the overall construction of a burner system for operating a combustion chamber. The burner system includes four operating stages, which each fulfill a certain function and are related to one another by an interdependent process procedure. The first section includes an inlet flow cross section 10 for a combustion air flow, a swirl generator 100 being arranged in this inlet cross section 10. The swirling flow formed in the swirl generator 100 is transferred into a mixing tube 20 without separation by means of a transition geometry 200 arranged downstream of the swirl generator. Such a transition geometry 200 is shown and described in the publication DE-44 35 266 A1, in FIG. 6, this publication being incorporated herein by reference. The actual combustion chamber 30, which is here symbolized only by the flame tube, is located downstream of the mixing tube 20. The mixing tube 20 satisfies the condition that a defined mixing section, in which perfect premixing of fuels of various types is achieved, is provided downstream of the swirl generator 100. Furthermore, this mixing section, i.e. the mixing tube 20, permits loss-free flow guidance so that, additionally interacting with the transition geometry 200, no reverse flow zone can form initially so that influence can be exerted on the mixing quality for all types of fuel by means of the length of the mixing tube 20. This mixing tube 20 does, however, also have another property which consists in the fact that the axial velocity profile has a clear maximum on the axis in the mixing tube itself so that flashback of the flame from the combustion chamber 30 is impossible. The axial velocity falls toward the wall in such a configuration. In order to prevent flashback in this region also, the mixing tube 20 is provided, in the flow direction and peripheral direction, with a number of regularly or irregularly distributed holes 21 of varied cross sections and directions. An air quantity flows to within the mixing tube 20 through these holes 21 and establishes a film along the wall and an increase in the velocity present there. Another possibility for achieving the same effect consists in the flow cross section of the mixing tube 20 experiencing a contraction downstream of the transition geometry 200 so that the whole velocity level is increased within the mixing tube 20.

In FIG. 1, holes 21 extend at an acute angle to the burner axis 60. In addition, the outlet from the transition geometry corresponds to the narrowest flow cross section of the mixing tube 20. As a result, the transition geometry 200 bridges over the respective difference in cross section without, in the process, negatively influencing the flow formed. If the measure selected should initiate an intolerable pressure loss in the guidance of the tube flow 40 along the mixing tube 20, aid to counter this can be afforded by providing a diffuser (not shown in any more detail in the figure) at the end of the mixing tube 20. The combustion chamber 30 abuts the end of the mixing tube 20 so that there is a cross-sectional discontinuity present between the two flow cross sections. It is only at this point that a central reverse flow zone 50, which has the properties of an immaterial flame holder, forms. If a flow boundary zone in which vortex separations occur due to the depression present there forms within this cross-sectional discontinuity during operation, this leads to a strengthened annular stabilization of the reverse flow zone 50. The combustion chamber 30 has a number of openings 31 at its end through which a quantity of air flows directly into the cross-sectional discontinuity and there contributes inter alia to the strengthening of the annular stabilization of the reverse flow zone 50.

The generation of a stable reverse flow zone 50 also requires a sufficiently high swirl number in a tube. If such a high swirl number is initially undesirable, stable reverse flow zones can be generated by the supply of small, strongly swirled air flows at the end of the tube, for example by means of tangential openings. It is assumed here that the air quantity necessary for this purpose is between approximately 5 and 20% of the total air quantity employed for operating the combustion chamber. Examples of designs for the edge at the end of the mixing tube 20 for strengthening the reverse flow zone 50 can be found in the publications DE-195 47 91 3 A1, FIG. 7 and DE-196 39 301 A1, FIGS. 8 to 11, both publications being incorporated herein in their entirety by reference.

FIG. 2 shows the head stage of the burner. The quadrilateral inlet flow cross section 10 and the swirl generator 100 integrated within it are shown in this figure. This inlet flow cross section 10 forms an autonomous burner unit and, in association with a number of further adjacent inlet flow cross sections, forms an annular combustion chamber, preferably for operating gas turbines, in particular a reheat chamber such as is shown in EP-0 620 362 A1, Figure Item 5. The inlet flow cross section 10 is of rectangular shape at the head end and merges into a square cross section over the length of the swirl generator 100.

The functional mode of the swirl generator 100 represented here can be found in the description of the publications DE-44 35 266 A1, FIGS. 2 to 5; DE-195 47 913 A1, FIGS. 2 to 5; and DE-196 39 301, FIGS. 2 to 5, these publications being incorporated herein in their entirety by reference.

The swirl generator (100) includes at least two hollow, conical partial bodies 101 which interlace with one another in the flow direction and whose respective longitudinal axes of symmetry extend offset to one another in such a way that the adjacent walls of the partial bodies 101 have, in their longitudinal extent, tangential ducts 102 for the inlet flow of the combustion air 115 into an internal space 103 formed by the partial bodies 101. At least one fuel nozzle is provided which acts on this internal space.

FIG. 3 shows a further embodiment of a swirl generator 150 according to the invention, which can be readily integrated into the inlet flow cross section of FIG. 2. Swirl generator 150 includes a central body 151, which has a radial or quasi-radial conduit 152 for the supply of fuels 153, 154. Individual swirl vanes 156, which extend in the axial direction, are anchored to the central body 151. These swirl vanes are enveloped by a tube 155, which is open at each end. At the head end, the tube 155 is open for the inlet flow of the combustion air 115 (see FIG. 1) and at the exhaust end, the tube 155 is open for the exit of the swirled combustion air (see FIG. 1) that differs with respect to the inlet flow of the combustion air.

Interdependently with the swirling of the combustion air 115, fuel is supplied so that, in a manner analogous to the swirl generator of FIG. 2, an initial premixing likewise occurs here; the final premixing then takes place downstream, on the one hand along the transition geometry (see FIG. 1, Item 200) and subsequently within the mixing tube (see FIG. 1, Item 20). Liquid fuels 154 are injected at the head end and centrally or quasi-centrally at openings 154*a*. Gaseous fuels 153, on the other hand, are injected by means of a number of openings 153*a* integrated into the swirl vanes 156. The number and the degree of swirl of the swirl vanes 156 vary to suit the respective requirements of the premixing process.

In the case of a decentralized fuel injection 154*a* of the liquid fuel 154, the injection angle of the fuel jet associated with the fuel nozzle 154*a* relative to the axis of the swirl generator is preferably made approximately equal to the setting angle of the swirl vanes 156. This measure ensures perfect premixing of the fuel employed while ensuring an operationally reliable and optimum flame positioning, i.e. enrichment of the central zone is permanently prevented by this means, and the fuel droplets are subjected to a stronger radial acceleration with increasing radius within the premixing section in such a way that they can satisfactorily mix into the combustion air entering there.

In the case of a burner swirl generator consisting of a plurality of shells, such as is found for example in EP-B1-0 321 809 or in the swirl generators of FIG. 1 (see the publications cited there), the wake zones along the side of a corresponding shell, or of the guide vanes or of the swirl vanes of a correspondingly conceived swirl generator are well suited as the injection position of the fuel. The droplet spray is there subjected to smaller aerodynamic forces and, correspondingly, better radial mixing into the combustion air.

The number of injection locations is matched to the shape of the burner, with at least one injection per shell or vane being provided.

What is claimed is:

1. A burner for operating a heat generator, the burner comprising:

a swirl generator comprising swirl vanes that receives a combustion air flow and that includes means for injecting at least one fuel into the combustion air flow, wherein the swirl generator is integrated into an inlet flow duct into which the combustion air flow flows, said inlet flow duct having a rectangular inlet flow cross section that merges into an approximately square or round cross section over the length of the swirl generator and completely surrounds the swirl generator in the radial direction, with the swirl generator being subjected to the combustion air flow only in the longitudinal direction;

a mixing section arranged downstream of the swirl generator, the mixing section having a first section part in a flow direction of the combustion air flow, and a number of ducts in a transition piece for the transfer of a flow formed in the swirl generator into a mixing tube connected downstream of the transition piece; and a combustion space formed by a cross-sectional expansion being arranged downstream of the mixing section.

2. The burner according to claim 1, wherein the swirl generator comprises at least two hollow, conical partial bodies, which are interlaced with one another in the flow direction, respective longitudinal axes of symmetry of these partial bodies extending offset to one another in such a way that adjacent walls of the partial bodies form, along their longitudinal extent, tangential ducts for the inlet flow of the combustion air flow into an internal space formed by the partial bodies.

3. The burner according to claim 2, wherein at least one fuel nozzle is present which acts on the internal space.

4. The burner according to claim 3, wherein the partial bodies have a vane-shaped profile in cross section.

5. The burner according to claim 1, wherein the swirl generator comprises a number of swirl vanes which are integrated into a closed envelope.

6. The burner according to claim 5, wherein the swirl generator has means for the injection of at least one fuel.

7. The burner according to claim 5, wherein the swirl generator has at least one fuel nozzle at an entrance end of the swirl generator, and wherein the at least one fuel nozzle is directed relative to the burner axis at approximately the same angle as a corresponding swirl vane.

8. The burner according to claim 3, wherein the number of fuel nozzles at least corresponds to the number of the partial bodies of the swirl generator.

9. The burner according to claim 2, wherein the number of ducts in the transition piece corresponds to the number of swirled partial flows formed by the swirl generator.

10. The burner according to claim 1, wherein the inlet flow duct is a constituent part of an annular combustion chamber.

* * * * *